US009804520B2

(12) United States Patent
Yamada et al.

(10) Patent No.: US 9,804,520 B2
(45) **Date of Patent: *Oct. 31, 2017**

(54) LIQUID DEVELOPER

(71) Applicant: KAO CORPORATION, Tokyo (JP)

(72) Inventors: Tatsuya Yamada, Wakayama (JP); Nobumichi Kamiyoshi, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/107,321

(22) PCT Filed: Dec. 22, 2014

(86) PCT No.: PCT/JP2014/083947

§ 371 (c)(1),
(2) Date: Jun. 22, 2016

(87) PCT Pub. No.: WO2015/098861

PCT Pub. Date: Jul. 2, 2015

(65) Prior Publication Data

US 2017/0003615 A1 Jan. 5, 2017

(30) Foreign Application Priority Data

Dec. 26, 2013 (JP) ..... 2013-269979

(51) Int. Cl.
*G03G 9/13* (2006.01)
*G03G 9/08* (2006.01)
*G03G 9/125* (2006.01)

(52) U.S. Cl.
CPC ..... *G03G 9/132* (2013.01); *G03G 9/0819* (2013.01); *G03G 9/125* (2013.01)

(58) Field of Classification Search
CPC ..... G03G 9/13; G03G 9/131; G03G 9/132
See application file for complete search history.

(56) References Cited

U.S. PATENT DOCUMENTS 5,981,133 A * 11/1999 Miyamoto ..... G03G 9/12 430/112
9,023,568 B2 * 5/2015 Kubo ..... G03G 9/08755 430/109.1
9,098,004 B2 * 8/2015 Yamada ..... G03G 9/135
2009/0148785 A1 6/2009 Yogome
2009/0253066 A1 10/2009 Yamada
2012/0315577 A1 12/2012 Moriguchi et al.
2013/0065176 A1 * 3/2013 Momotani ..... G03G 9/125 430/114
2013/0171555 A1 7/2013 Kubo et al.
2013/0273467 A1 10/2013 Ashizawa et al.
2014/0127623 A1 * 5/2014 Inoue ..... G03G 9/131 430/112
2014/0186763 A1 7/2014 Yamada et al.
2014/0186764 A1 7/2014 Yamada et al.

FOREIGN PATENT DOCUMENTS

JP 2007-121660 A 5/2007
JP 2009-157346 A 7/2009
JP 2009-229608 A 10/2009
JP 2009-251086 A 10/2009
JP 2010-224299 10/2010
JP 2012-107228 A 6/2012
JP 2012-207193 A 10/2012
JP 2013-3197 A 1/2013
JP 2013-97059 A 5/2013
JP 2013-105035 5/2013
JP 2013-159737 A 8/2013
JP 2013-231911 A 11/2013
JP 2013-231912 11/2013
JP 2013-235248 A 11/2013
JP 2014-118566 6/2014
JP 2014-142624 A 8/2014
JP 2014-142625 A 8/2014
JP 2014-232211 12/2014
WO WO 2010/106873 A1 9/2010

OTHER PUBLICATIONS

International Search Report issued Mar. 3, 2015 in PCT/JP2014/083947.

* cited by examiner

*Primary Examiner* — Hoa V Le
(74) *Attorney, Agent, or Firm* — Oblon, McClelland, Maier & Neustadt, L.L.P.

(57) ABSTRACT

A liquid developer containing toner particles containing a resin and a basic dispersant in an insulating liquid, wherein the resin contains a polyester A having a furan ring. The liquid developer of the present invention is suitably used in development and the like of latent images formed in an electrophotographic method, an electrostatic recording method, an electrostatic printing method, or the like.

17 Claims, No Drawings

LIQUID DEVELOPER

FIELD OF THE INVENTION

The present invention relates to a liquid developer usable in development of latent images formed in an electrophotographic method, an electrostatic recording method, an electrostatic printing method, or the like.

BACKGROUND OF THE INVENTION

Developers for electrophotography are a dry developer in which toner components containing materials containing a colorant and a resin binder are used in a dry state, and a liquid developer in which toner components are dispersed in an insulating carrier liquid.

Liquid developers allow the toner particles to form into smaller particles, so that they give excellent image quality, thereby making it suitable for commercial printing applications. In addition, in the recent years, with the increasing demands for speeding up, liquid developers with lowered viscosities are also in demand. In other words, liquid developers in which toner particles are stably dispersed at smaller particle sizes and lower viscosities are in demand.

Further, in order to meet the demands for speeding up, liquid developers in which the toner particles exhibit high electrophoretic property, in other words, having excellent chargeability are demanded.

Patent Publication 1 discloses as liquid developers having excellent positively chargeable chargeability and environmental stability, in which toner particles having an appropriate particle size are dispersed, positively chargeable liquid developers in which toner particles are dispersed in an insulating liquid, wherein a liquid developers are characterized in that the toner particles are constituted by matrix particles having an anionic group on surfaces thereof and a film coating the above-mentioned matrix particles, wherein the film is a laminate of at least a first cation layer having repeating structural units derived from a cationic polymerizable surfactant having a cationic group, a hydrophobic group and a polymerizable group, an anion layer having repeating units derived from an anionic polymerizable surfactant having an anionic group, a hydrophobic group and a polymerizable group, and a second cation layer having repeating structural units derived from the above-mentioned cationic polymerizable surfactant in this order, from the matrix particle side, and wherein the outermost layer of the above-mentioned film is a cation layer having repeating structure units derived from the above-mentioned cationic polymerizable surfactant.

Patent Publication 2 describes that a resin binder for a toner containing an amorphous polyester having a furan ring has excellent low-temperature fusing ability and storage property.

In addition, Patent Publication 3 discloses a resin binder for a toner containing an amorphous polyester having a furan ring obtained by polycondensing raw material monomers containing at least a carboxylic acid component and an alcohol component, wherein the raw material monomers contain one or more members selected from a carboxylic acid or an alcohol having a specified structure having a furan ring, and one or more members selected from a carboxylic acid compound having a furan ring other than the carboxylic acid having a specified structure having a furan ring and an alcohol having a furan ring other than the alcohol having a specified structure having a furan ring, and wherein the resin binder for a toner has excellent low-temperature fusing ability and storage property, and has favorable electric stability under high-temperature, high-humidity conditions.

Patent Publication 1: Japanese Patent Laid-Open No. 2007-121660

Patent Publication 2: Japanese Patent Laid-Open No. 2012-107228

Patent Publication 3: Japanese Patent Laid-Open No. 2013-231911

SUMMARY OF THE INVENTION

The present invention relates to a liquid developer containing toner particles containing a resin and a basic dispersant in an insulating liquid, wherein the resin contains a polyester A having a furan ring.

DETAILED DESCRIPTION OF THE INVENTION

In liquid developers, dispersion stability of toner particles in an insulating liquid is lowered by making the toner particles smaller in particle sizes and lowering the viscosity of the insulating liquid. A dispersant is used in order to improve the disadvantages, but the dispersant itself is chargeable, so that the dispersant is more likely to influence chargeability and undesirably lowers electrophoretic property of the toner particles. In addition, in a case where a charge control agent or the like is used to provide chargeability to the toner particles, sufficient charging effects cannot be obtained in some cases if materials released from the toner particles to the insulating liquid are present; therefore, it is difficult to improve electrophoretic property of the toner particles, while securing dispersion stability, i.e. storage stability of the toner particles.

The present invention relates to a liquid developer having excellent storage stability, electrophoretic property and fusing ability.

The liquid developer of the present invention exhibits some effects of having excellent storage stability, electrophoretic property and fusing ability.

The feature of the liquid developer of the present invention is in that the liquid developer contains a polyester resin containing a furan ring and a basic dispersant; and the liquid developer having excellent storage stability, electrophoretic property and fusing ability is obtained.

The reasons why such effects are exhibited are not elucidated, and they are considered to be as follows.

The present invention contains a polyester resin containing a furan ring. Since a furan ring backbone has a high acidity, the furan ring is likely to be attracted to a basic compound. Therefore, a basic dispersant is firmly adsorbed onto the toner particles using a polyester resin containing a furan ring. It is considered from these matters that the proportion of the free basic dispersant not adsorbed onto the toner particles in a liquid developer is reduced, and at the same time the toner particles in which the amount of the basic dispersant adsorbed is increased have relatively enhanced positive chargeability, so that electrophoretic property is improved. In addition, since the dispersion stability of the toner particles is improved by increase of the amount of the dispersant adsorbed, the storage stability of the liquid developer is improved. Further, it is considered that the resin is plasticized during heat-fusing of the basic dispersant, and at the same time a plurality of adsorbing groups of the basic dispersant are adsorbed to a polyester resin having a furan ring between toner particles, whereby linkages are formed between toner particles and fusing strength is enhanced, so that fusing ability is improved.

[Resin]

The resin in a liquid developer of the present invention is a resin which serves as a resin binder of the toner particles, and contains a polyester A having a furan ring, from the viewpoint of improving electrophoretic property of the toner particles in the liquid developer, from the viewpoint of improving fusing ability of the liquid developer, and from the viewpoint of improving dispersion stability of the toner particles in the liquid developer, thereby improving storage stability.

The content of the polyester A is preferably 50% by mass or more, more preferably 80% by mass or more, even more preferably 90% by mass or more, even more preferably 95% by mass or more, even more preferably substantially 100% by mass, and even more preferably 100% by mass, of the resin, in other words, it is even more preferable that only the polyester A is used as a resin, but resins other than the polyester A may be contained within the range that would not impair the effects of the present invention. The resins other than the polyester A include, for example, polyesters other than the polyester A, polystyrenes, styrenic resins which are homopolymers or copolymers containing styrene or substituted styrenes, such as styrene-propylene copolymers, styrene-butadiene copolymers, styrene-vinyl chloride copolymers, styrene-vinyl acetate copolymers, styrene-maleic acid copolymers, styrene-acrylate copolymers, and styrene-methacrylate copolymers; epoxy resins, rosin-modified maleic acid resins, polyethylene resins, polypropylene, polyurethane, silicone resins, phenolic resins, aliphatic or alicyclic hydrocarbon resins, and the like.

The polyester A is a polyester obtained by polycondensing a carboxylic acid component and an alcohol component, using as raw material monomers at least a carboxylic acid component containing a carboxylic acid compound having a furan ring and/or an alcohol component containing an alcohol having a furan ring, i.e. a polyester obtained by polycondensing a carboxylic acid component and an alcohol component, and it is preferable that at least a part of one or both of the carboxylic acid component and the alcohol component have a furan ring, and the furan ring having a structure represented by formula (Ia) or (Ib):

(Ia)

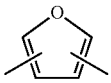

(Ib)

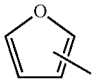

is preferred.

The carboxylic acid compound having a furan ring includes furan dicarboxylic acid compounds such as 2,5-furan dicarboxylic acid, 2,4-furan dicarboxylic acid, 2,3-furan dicarboxylic acid, and 3,4-furan dicarboxylic acid; furan carboxylic acid compounds such as 2-furan carboxylic acid and 3-furan carboxylic acid; hydroxyfuran carboxylic acid compounds such as 5-hydroxymethyl-furan-2-carboxylic acid; carboxylic acid compounds such as furfuryl acetic acid compounds and 3-carboxy-4-methyl-5-propyl-2-furan propionate; and the like. In the present specification, the carboxylic acid compound includes carboxylic acids, esters formed between the carboxylic acids and alcohols having 1 or more and 3 or less carbon atoms, and acid anhydrides thereof. In addition, hydroxycarboxylic acid compounds are included in the carboxylic acid compound.

Among them, at least one member selected from the group containing the furan dicarboxylic acid compounds, the furan carboxylic acid compounds, and the hydroxyfuran carboxylic acid compounds are preferred, the furan dicarboxylic acid compounds are more preferred, and 2,5-furan dicarboxylic acid is even more preferred, from the viewpoint of improving electrophoretic property of the toner particles in the liquid developer, from the viewpoint of improving fusing ability of the liquid developer, and from the viewpoint of improving dispersion stability of the toner particles in the liquid developer, thereby improving storage stability.

The alcohol having a furan ring includes furan di-alcohols such as dihydroxyfuran; hydroxymethyl furfuryl alcohols such as 5-hydroxymethyl furfuryl alcohol; furfuryl alcohol; 5-hydroxymethyl furfural, and the like.

A total amount of the carboxylic acid compound having a furan ring and the alcohol having a furan ring is preferably 10% by mol or more, more preferably 20% by mol or more, and even more preferably 30% by mol or more, of the total amount of the carboxylic acid component and the alcohol component of the polyester A, from the viewpoint of improving electrophoretic property of the toner particles in the liquid developer, from the viewpoint of improving fusing ability of the liquid developer, and from the viewpoint of improving dispersion stability of the toner particles in the liquid developer, thereby improving storage stability. In addition, the total amount is preferably 100% by mol or less, more preferably 80% by mol or less, even more preferably 60% by mol or less, and even more preferably 50% by mol or less.

Further, the content of the carboxylic acid compound having a furan ring is preferably 20% by mol or more, more preferably 40% by mol or more, even more preferably 60% by mol or more, even more preferably 80% by mol or more, even more preferably 90% by mol or more, even more preferably substantially 100% by mol, and even more preferably 100% by mol, of the carboxylic acid component of the polyester A, from the viewpoint of improving electrophoretic property of the toner particles in the liquid developer, from the viewpoint of improving fusing ability of the liquid developer, and from the viewpoint of improving dispersion stability of the toner particles in the liquid developer, thereby improving storage stability.

The content of the furan dicarboxylic acid compound is preferably 20% by mol or more, more preferably 40% by mol or more, even more preferably 50% by mol or more, even more preferably 60% by mol or more, even more preferably 70% by mol or more, even more preferably 80% by mol or more, even more preferably 90% by mol or more, even more preferably substantially 100% by mol, and even more preferably 100% by mol, of the carboxylic acid component of the polyester A, from the viewpoint of improving electrophoretic property of the toner particles in the liquid developer, from the viewpoint of improving fusing ability of the liquid developer, and from the viewpoint of improving dispersion stability of the toner particles in the liquid developer, thereby improving storage stability.

The content of the alcohol having a furan ring is preferably 10% by mol or more, and more preferably 20% by mol or more, and preferably 100% by mol or less, more preferably 90% by mol or less, even more preferably 80% by mol or less, and even more preferably 60% by mol or less, of the alcohol component of the polyester A, from the viewpoint of improving electrophoretic property of the toner particles in the liquid developer, from the viewpoint of improving fusing ability of the liquid developer, and from the viewpoint of improving dispersion stability of the toner particles in the liquid developer, thereby improving storage stability.

Here, in a case where the resin binder contains a plural polyester A's, the above-mentioned total amount of the carboxylic acid compound having a furan ring and the alcohol having a furan ring, the content of the carboxylic acid compound having a furan ring, the content of the furan dicarboxylic acid compound, and the content of the alcohol having a furan ring are obtained by the sum of the products multiplying the content of each of the compounds in each of the polyester A's and a mass percentage of each of the polyester A's.

As an alcohol component other than the alcohol having a furan ring, a dihydric or higher hydric alcohol may be contained.

The dihydric alcohol include an aliphatic diol, an aromatic diol, and the like, and the aliphatic diol is preferred, from the viewpoint of improving electrophoretic property of the toner particles in the liquid developer, and from the viewpoint of improving fusing ability of the liquid developer. The number of carbon atoms of the aliphatic diol is preferably 2 or more, and more preferably 3 or more, and preferably 10 or less, more preferably 8 or less, and even more preferably 4 or less.

The aliphatic diol includes ethylene glycol, 1,2-propanediol, 1,3-propanediol, 1,2-butanediol, 1,3-butanediol, 1,4-butanediol, 1,2-pentanediol, 1,3-pentanediol, 1,4-pentanediol, 1,5-pentanediol, 1,2-hexanediol, 1,3-hexanediol, 1,4-hexanediol, 1,5-hexanediol, 1,6-hexanediol, 1,4-butenediol, neopentyl glycol, 2,3-butanediol, 2,3-pentanediol, 2,4-pentanediol, 2,3-hexanediol, 3,4-hexanediol, 2,4-hexanediol, 2,5-hexanediol, and the like.

Among the above-mentioned aliphatic diols, an aliphatic diol having a hydroxyl group bound to a secondary carbon atom is preferred, from the viewpoint of improving electrophoretic property of the toner particles in the liquid developer, and from the viewpoint of improving fusing ability of the liquid developer. Specific preferred examples include 1,2-propanediol, 1,2-butanediol, 1,3-butanediol, 2,3-butanediol, 1,2-pentanediol, 1,3-pentanediol, 2,3-pentanediol, 2,4-pentanediol, and the like, and 1,2-propanediol is preferable, from the viewpoint of improving electrophoretic property of the toner particles in the liquid developer, and from the viewpoint of improving fusing ability of the liquid developer.

The content of the aliphatic diol is preferably 20% by mol or more, more preferably 50% by mol or more, even more preferably 70% by mol or more, even more preferably substantially 100% by mol, and even more preferably 100% by mol, of the alcohol component other than the alcohol having a furan ring, from the viewpoint of improving electrophoretic property of the toner particles in the liquid developer, and from the viewpoint of improving fusing ability of the liquid developer.

The content of the aliphatic diol having a hydroxyl group bound to a secondary carbon atom is preferably 20% by mol or more, more preferably 50% by mol or more, even more preferably 70% by mol or more, even more preferably substantially 100% by mol, and even more preferably 100% by mol, of the alcohol component other than the alcohol having a furan ring, from the viewpoint of improving electrophoretic property of the toner particles in the liquid developer, and from the viewpoint of improving fusing ability of the liquid developer.

In a case where the alcohol component does not contain an alcohol having a furan ring, the content of the aliphatic diol is preferably 20% by mol or more, more preferably 50% by mol or more, even more preferably 70% by mol or more, even more preferably substantially 100% by mol, and even more preferably 100% by mol, of the alcohol component, from the viewpoint of improving electrophoretic property of the toner particles in the liquid developer, and from the viewpoint of improving fusing ability of the liquid developer.

In a case where the alcohol component does not contain an alcohol having a furan ring, the content of the aliphatic diol having a hydroxyl group bound to a secondary carbon atom is preferably 20% by mol or more, more preferably 50% by mol or more, even more preferably 70% by mol or more, even more preferably substantially 100% by mol, and even more preferably 100% by mol, of the alcohol component, from the viewpoint of improving electrophoretic property of the toner particles in the liquid developer, and from the viewpoint of improving fusing ability of the liquid developer.

Specific examples of aromatic diol are preferably an alkylene oxide adduct of bisphenol A represented by the formula (II):

(II)

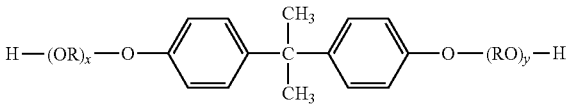

wherein RO and OR are an oxyalkylene group, wherein R is an ethylene group and/or a propylene group; and each of x and y is a positive number showing an average number of moles of alkylene oxide added, wherein the number of the sum of x and y is preferably 1 or more and 16 or less, more preferably 1 or more and 8 or less, and even more preferably 1.5 or more and 4 or less, from the viewpoint of improving fusing ability of the liquid developer, and from the viewpoint of improving dispersion stability of the toner particles in the liquid developer, thereby improving storage stability.

Specific examples of the alkylene oxide adduct of bisphenol A represented by the formula (II) include an alkylene oxide adduct of bisphenol A, such as a polyoxypropylene adduct of 2,2-bis(4-hydroxyphenyl)propane and a polyoxyethylene adduct of 2,2-bis(4-hydroxyphenyl)propane; and the like.

The trihydric or higher hydric alcohol specifically includes sorbitol, 1,4-sorbitan, pentaerythritol, glycerol, trimethylolpropane, and the like.

As the carboxylic acid component other than the carboxylic acid compound having a furan ring, a dicarboxylic or higher carboxylic acid compound may be contained. In the present invention, a carboxylic acid, acid anhydride, derivatives such as alkyl esters having 1 or more and 3 or less carbon atoms, and the like are collectively called as carboxylic acid compounds.

The carboxylic acid component other than the carboxylic acid compound having a furan ring includes an aromatic dicarboxylic acid compound, an aliphatic dicarboxylic acid compound, a tricarboxylic or higher carboxylic acid compound, and the like.

The aromatic dicarboxylic acid compound includes phthalic acid, isophthalic acid, terephthalic acid, acid anhydrides thereof, alkyl esters thereof having 1 or more and 3 or less carbon atoms, and the like.

The aliphatic dicarboxylic acid compound includes oxalic acid, malonic acid, maleic acid, fumaric acid, citraconic acid, itaconic acid, glutaconic acid, succinic acid, adipic acid, sebacic acid, azelaic acid, succinic acid substituted with an alkyl group having 1 or more and 20 or less carbon atoms or an alkenyl group having 2 or more and 20 or less carbon atoms, acid anhydrides thereof, alkyl esters thereof having 1 or more and 3 or less carbon atoms, and the like.

The tricarboxylic or higher carboxylic acid compound includes 1,2,4-benzenetricarboxylic acid (trimellitic acid), 1,2,4,5-benzenetetracarboxylic acid (pyromellitic acid), anhydrides thereof, alkyl esters thereof having 1 or more and 3 or less carbon atoms, and the like.

Among them, as the carboxylic acid component other than the carboxylic acid compound having a furan ring, terephthalic acid and fumaric acid are preferable, and terephthalic acid is more preferable, from the viewpoint of improving fusing ability of the liquid developer, and from the viewpoint of improving dispersion stability of the toner particles in the liquid developer, thereby improving storage stability.

The alcohol component may properly contain a monohydric alcohol not having a furan ring, and the carboxylic acid component may properly contain a monocarboxylic acid component not having a furan ring, from the viewpoint of adjusting the molecular weight and the softening point of the polyester.

The carboxylic acid component and the alcohol component in the polyester A are in an equivalent ratio, i.e. COOH group or groups/OH group or groups, of preferably 0.70 or more, and more preferably 0.75 or more, from the viewpoint of reducing an acid value of the polyester A, and preferably 1.10 or less, and more preferably 1.05 or less.

The polycondensation reaction of the alcohol component and the carboxylic acid component can be carried out by polycondensing the components in an inert gas atmosphere at a temperature of from 180° C. or higher and 250° C. or lower or so, optionally in the presence of an esterification catalyst, an esterification promoter, a polymerization inhibitor or the like. The esterification catalyst includes tin compounds such as dibutyltin oxide and tin(II) 2-ethylhexanoate; titanium compounds such as titanium diisopropylate bistriethanolaminate; and the like. The amount of the esterification catalyst used is preferably 0.01 parts by mass or more, and more preferably 0.1 parts by mass or more, and preferably 1.5 parts by mass or less, and more preferably 1.0 part by mass or less, based on 100 parts by mass of a total amount of the alcohol component and the carboxylic acid component. The esterification promoter includes gallic acid, and the like. The amount of the esterification promoter used is preferably 0.001 parts by mass or more, and more preferably 0.01 parts by mass or more, and preferably 0.5 parts by mass or less, and more preferably 0.1 parts by mass or less, based on 100 parts by mass of a total amount of the alcohol component and the carboxylic acid component. The polymerization inhibitor includes t-butylcatecol, and the like. The amount of the polymerization inhibitor used is preferably 0.001 parts by mass or more, and more preferably 0.01 parts by mass or more, and preferably 0.5 parts by mass or less, and more preferably 0.1 parts by mass or less, based on 100 parts by mass of a total amount of the alcohol component and the carboxylic acid component.

The softening point of the polyester A is preferably 160° C. or lower, more preferably 120° C. or lower, even more preferably 110° C. or lower, and even more preferably 105° C. or lower, from the viewpoint of improving fusing ability of the liquid developer. In addition, the softening point is preferably 70° C. or higher, more preferably 80° C. or higher, even more preferably 85° C. or higher, and even more preferably 88° C. or higher, from the viewpoint of improving dispersion stability of the toner particles in the liquid developer, thereby improving storage stability.

The softening point of the polyester A can be controlled by adjusting the kinds and compositional ratios of the alcohol component and the carboxylic acid component, an amount of a catalyst, or the like, or selecting reaction conditions such as reaction temperature, reaction time and reaction pressure.

The glass transition temperature of the polyester A is preferably 80° C. or lower, more preferably 65° C. or lower, and even more preferably 60° C. or lower, from the viewpoint of improving fusing ability of the liquid developer. In addition, the glass transition temperature is preferably 40° C. or higher, more preferably 45° C. or higher, and even more preferably 50° C. or higher, from the viewpoint of improving dispersion stability of the toner particles in the liquid developer, thereby improving storage stability.

The glass transition temperature of the polyester A can be controlled by the kinds and compositional ratios of the alcohol component and the carboxylic acid component, and the like.

The acid value of the polyester A is preferably 110 mgKOH/g or less, more preferably 70 mgKOH/g or less, even more preferably 50 mgKOH/g or less, and even more preferably 30 mgKOH/g or less, from the viewpoint of improving electrophoretic property of the toner particles in the liquid developer, and from the viewpoint of improving dispersion stability of the toner particles in the liquid developer, thereby improving storage stability. In addition, the acid value is preferably 3 mgKOH/g or more, more preferably 5 mgKOH/g or more, even more preferably 8 mgKOH/g or more, even more preferably 10 mgKOH/g or more, even more preferably 15 mgKOH/g or more, and even more preferably 20 mgKOH/g or more, from the viewpoint of reducing the viscosity of the liquid developer.

The acid value of the polyester A can be controlled by adjusting the kinds and compositional ratios of the alcohol component and the carboxylic acid component, an amount of a catalyst, or the like, or selecting reaction conditions such as reaction temperature, reaction time and reaction pressure.

Here, in the present invention, the polyester may be a modified polyester to an extent that the properties thereof are not substantially impaired. The modified polyester refers to, for example, a composite resin containing a polycondensed resin component obtained by polycondensing an alcohol component and a carboxylic component, and a styrenic resin component, and a polyester grafted or blocked with a phenol, a urethane, an epoxy or the like according to a method described in Japanese Patent Laid-Open No. Hei-11-133668, Hei-10-239903, Hei-8-20636, or the like.

[Pigment]

As the pigment, all of the pigments which are used as colorants for toners can be used, and carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, isoindoline, disazo yellow, or the like can be used. In the present invention, the toner particles may be any of black toners and color toners.

The content of the pigment is preferably 100 parts by mass or less, more preferably 70 parts by mass or less, even more preferably 50 parts by mass or less, and even more preferably 25 parts by mass or less, based on 100 parts by mass of the resin, from the viewpoint of improving fusing ability of the liquid developer. In addition, the content is preferably 5 parts by mass or more, more preferably 10 parts by mass or more, and even more preferably 15 parts by mass or more, from the viewpoint of improving optical density of the liquid developer.

In the present invention, an additive such as a releasing agent, a charge control agent, a charge control resin, a magnetic particulate, a fluidity improver, an electric conductivity modifier, a reinforcing filler such as a fibrous material, an antioxidant, or a cleanability improver may be further properly used as a toner raw material.

[Method for Producing Toner Particles]

The method for obtaining toner particles includes a method including melt-kneading toner raw materials containing a resin and a pigment, and pulverizing the melt-kneaded mixture obtained to provide toner particles; a method including mixing an aqueous resin dispersion and an aqueous pigment dispersion, thereby unifying the resin particles and the pigment particles; and a method including stirring an aqueous resin dispersion and a pigment at high speed; and the like. The method including melt-kneading toner raw materials, and pulverizing the melt-kneaded mixture obtained is preferred, from the viewpoint of improving developability and fusing ability of the liquid developer.

The melt-kneading of toner raw materials can be carried out with a known kneader, such as a closed kneader, a single-screw or twin-screw kneader, or a continuous open-roller type kneader. In the method for producing a liquid developer of the present invention, it is preferable that the melt-kneading is carried out with an open-roller type kneader, from the viewpoint of improving dispersibility of the pigment in the resin, and from the viewpoint of improving an yield of the toner particles after pulverization.

It is preferable that the toner raw materials containing a resin and a pigment are previously mixed with a mixer such as a Henschel mixer, a Super mixer or a ball-mill, and thereafter fed to a kneader. Among these mixers, Henschel mixer is preferred, from the viewpoint of improving dispersibility of the pigment in the resin.

The mixing of the toner raw materials with a Henschel mixer is carried out by adjusting a peripheral speed of agitation, and a mixing time. The peripheral speed of agitation is preferably 10 m/sec or more and 30 min/sec or less, from the viewpoint of improving dispersibility of the pigment in the resin. In addition, the agitation time is preferably 1 minute or more and 10 minutes or less, from the viewpoint of improving dispersibility of the pigment in the resin.

The open-roller type kneader refers to a kneader of which kneading unit is an open type, not being tightly closed, and the kneading heat generated during the melt-kneading can be easily dissipated. The open-roller type kneader used in the present invention is provided with a plurality of feeding ports for raw materials and a discharging port for a kneaded mixture along the shaft direction of the roller, and it is preferable that the open-roller type kneader is a continuous open roller-type kneader, from the viewpoint of production efficiency.

It is preferable that the open-roller type kneader used in the present invention is provided with at least two kneading rollers having different temperatures. The temperature of the rollers can be adjusted by, for example, a temperature of a heating medium passing through the inner portion of the rollers, and each of the rollers may be divided in two or more portions in the inner portion of the rollers, the rollers being passed through with heating media of different temperatures.

In the present invention, it is preferable that in both of the rollers, the temperature of the discharge port for a kneaded mixture of the kneader is set at a temperature equal to or lower than the temperature which is 10° C. higher than softening point of the resin, from the viewpoint of improving miscibility of the toner raw materials.

It is preferable that the set temperature of the upstream side of kneading and the set temperature of the downstream side of kneading in the heat roller are set such that the set temperature of the upstream side is higher than that of the downstream side, from the viewpoint of making the adhesiveness of the kneaded mixture to the roller at an upstream side favorable and strongly kneading at a downstream side.

In the roller of which set temperature at an upstream side of kneading is lower, which is also referred to as a cooling roller, the set temperature at an upstream side of kneading may be the same as or different from the set temperature of the downstream side of kneading.

The rollers of the open roller-type kneader are preferably those having peripheral speeds that are different from each other. In the open roller-type kneader provided with the two rollers mentioned above, it is preferable that the heat roller having a higher temperature is a roller having a higher peripheral speed, i.e. a high-rotation roller, and that the cooling roller having a lower temperature is a roller having a lower peripheral speed, i.e. a low-rotation roller, from the viewpoint of improving fusing ability of the liquid developer.

The peripheral speed of the high-rotation roller is preferably 2 m/min or more, and more preferably 5 m/min or more, and preferably 100 m/min or less, and more preferably 75 m/min or less. The peripheral speed of the low-rotation roller is preferably 2 m/min or more, and more preferably 4 i/min or more, and preferably 100 in/min or less, more preferably 60 m/min or less, and even more preferably 50 nm/min or less. In addition, the ratio of the peripheral speeds of the two rollers, i.e. low-rotation roller/high-rotation roller, is preferably from 1/10 to 9/10, and more preferably from 3/10 to 8/10.

The gap between the two rollers, i.e. clearance, at an end part on the upstream side of the kneading is preferably 0.1 mm or more, and preferably 3 mm or less, and more preferably 1 mm or less.

In addition, structures, size, materials and the like of each the rollers are not particularly limited. The surface of the roller has a groove used in kneading, and the shapes of grooves include linear, spiral, wavy, rugged or other forms.

The feeding rates and the average residence time of the raw material mixture differ depending upon the size of the rollers used, components of the raw materials, and the like, so that optimal conditions among these conditions may be selected.

The kneaded mixture obtained by melt-kneading the components with an open roller-type kneader is cooled to an extent that is pulverizable, and the obtained mixture is subjected to ordinary processes such as a pulverizing step and optionally a classifying step, whereby the toner particles can be obtained.

The pulverizing step may be carried out in divided multi-stages. For example, the melt-kneaded mixture may be roughly pulverized to a size of from 1 to 5 mm or so, and the roughly pulverized product may then be further finely pulverized. In addition, in order to improve productivity during the pulverizing step, the melt-kneaded mixture may be mixed with fine inorganic particles made of hydrophobic silica or the like, and then pulverized.

The pulverizer usable in the pulverizing step is not particularly limited. For example, the pulverizer suitably used in the rough pulverization includes an atomizer, Rotoplex, and the like, or a hammer-mill or the like may be used. In addition, the pulverizer suitably used in the fine pulverization includes a fluidised bed-counter jet mill, an air jet mill, a rotary mechanical mill, and the like.

The above pulverized product may be classified with a classifier as occasion demands. The classifier used in the classifying step includes an air classifier, a rotor type classifier, a sieve classifier, and the like. The pulverized product which is insufficiently pulverized and removed during the classifying step may be subjected to the pulverizing step again, and the pulverizing step and the classifying step may be repeated as occasion demands.

The toner particles obtained in the above-mentioned pulverizing step and the classifying step optionally carried out have a volume-median particle size $D_{50}$ of preferably 3 μm or more, and more preferably 4 μm or more, and preferably 15 μm or less, more preferably 12 μm or less, from the viewpoint of improving productivity of the wet-milling step set forth below. The volume-median particle size $D_{50}$ as used herein means a particle size of which cumulative volume frequency calculated on a volume percentage is 50% counted from the smaller particle sizes.

[Method for Producing Liquid Developer]

The toner particles are dispersed in an insulating liquid in the presence of a basic dispersant to provide a liquid developer. It is preferable that a liquid developer is obtained by dispersing toner particles in an insulating liquid, and thereafter subjecting the toner particles to wet-milling, from the viewpoint of making particle sizes of toner particles smaller in a liquid developer, and from the viewpoint of reducing viscosity of the liquid developer.

[Basic Dispersant]

A dispersant is used for stably dispersing toner particles in an insulating liquid, and in the present invention, a basic dispersant having a basic adsorbing group as an adsorbing group is contained, from the viewpoint of improving adsorbability to the polyester A, thereby improving electrophoretic property of the toner particles, from the viewpoint of improving fusing ability of a liquid developer, and from the viewpoint of improving dispersion stability of the toner particles in the liquid developer, thereby improving storage stability.

The basic dispersant is preferably one having a structure including a basic adsorbing group and a dispersing group in the same molecule, and more preferably one having a structure including a basic adsorbing group as a main chain, and a dispersing group as a side chain. The basic adsorbing group includes an amino group, an amide group, an imino group, a pyrrolidone group, a pyridine group, and the like, and an amino group, an amide group, and an imino group are preferred, from the viewpoint of improving adsorbability to the polyester A, thereby improving electrophoretic property of the toner particles, from the viewpoint of improving fusing ability of a liquid developer, and from the viewpoint of improving dispersion stability of the toner particles in a liquid developer, thereby improving storage stability. The dispersing group is preferably a group which is compatible with an insulating liquid, and specifically one having a hydrocarbon chain or a hydroxyhydrocarbon chain is more preferred. Among the basic dispersants mentioned above, a condensate formed between a polyimine and a carboxylic acid is preferred, from the viewpoint of improving adsorbability to the polyester A, thereby improving electrophoretic property of the toner particles, from the viewpoint of improving fusing ability of a liquid developer, and from the viewpoint of improving dispersion stability of the toner particles in a liquid developer, thereby improving storage stability.

As the polyimine used as a raw material for the condensate formed between a polyimine and a carboxylic acid, a polyalkyleneimine is preferred, from the viewpoint of improving dispersion stability of the toner particles in a liquid developer, thereby improving storage stability. Specific examples of the polyalkyleneimine includes polyethyleneimine, polypropyleneimine, polybutyleneimine, and the like, and the polyethyleneimine is more preferred, from the viewpoint of improving adsorbability to the polyester A, thereby improving electrophoretic property of the toner particles, from the viewpoint of improving fusing ability of a liquid developer, and from the viewpoint of improving dispersion stability of the toner particles in a liquid developer, thereby improving storage stability.

As the carboxylic acid used as a raw material for the condensate formed between a polyimine and a carboxylic acid, a saturated or unsaturated aliphatic carboxylic acid having preferably 10 or more and 30 or less carbon atoms, more preferably 12 or more and 24 or less carbon atoms, and even more preferably 16 or more and 22 or less carbon atoms is preferred, and a linear, saturated or unsaturated aliphatic carboxylic acid is more preferred, from the viewpoint of improving fusing ability of the liquid developer, and from the viewpoint of improving dispersion stability of the toner particles in a liquid developer, thereby improving storage stability. Specific examples of the carboxylic acid include linear saturated aliphatic carboxylic acids such as lauric acid, myristic acid, palmitic acid, and stearic acid; linear unsaturated aliphatic carboxylic acids such as oleic acid, linoleic acid, and linolenic acid, and the like.

In addition, the carboxylic acid used as a raw material for the condensate formed between a polyimine and a carboxylic acid may have a substituent such as a hydroxy group, and a hydroxycarboxylic acid having a hydroxy group as a substituent is preferred, from the viewpoint of improving dispersion stability of the toner particles in a liquid developer, thereby improving storage stability. The hydroxycarboxylic acid includes a hydroxycarboxylic acid such as mevalonic acid, ricinoleic acid, and 12-hydroxystearic acid. The hydroxycarboxylic acid may be a condensate thereof.

From the above-mentioned viewpoints, as the carboxylic acid used as a raw material for the condensate formed between a polyimine and a carboxylic acid, hydroxy aliphatic carboxylic acid having preferably 10 or more and 30 or less carbon atoms, more preferably 12 or more and 24 or less carbon atoms, and even more preferably 16 or more and 22 or less carbon atoms, and the condensates thereof are preferred, and 12-hydroxystearic acid and condensates thereof are more preferred.

Specific examples of the condensate formed between a polyimine and a carboxylic acid include SOLSPARSE 11200, SOLSPARSE 13940, hereinabove manufactured by The Lubrizol Corporation, and the like.

The amount of the basic dispersant is, as an effective content, preferably 0.5 parts by mass or more, more preferably 1 part by mass or more, and even more preferably 2 parts by mass or more, based on 100 parts by mass of the toner particles, from the viewpoint of improving adsorbability to the polyester A, thereby improving electrophoretic property of the toner particles, and from the viewpoint of inhibiting the aggregation of the toner particles and reducing the viscosity of the liquid developer. In addition, amount of the basic dispersant is preferably 20 parts by mass or less, more preferably 15 parts by mass or less, even more preferably 10 parts by mass or less, and even more preferably 7 parts by mass or less, from the viewpoint of reducing the free dispersant thereby improving electrophoretic property of the toner particles, and from the viewpoint of improving the developability and fusing ability of the liquid developer.

In addition, the content of the condensate formed between a polyimine and a carboxylic acid in the basic dispersant is preferably 50% by mass or more, more preferably 70% by mass or more, even more preferably 90% by mass or more, even more preferably substantially 100% by mass, and even more preferably 100% by mass, of the effective content of the basic dispersant, from the viewpoint of improving adsorbability to the polyester A, thereby improving electrophoretic property of the toner particles, from the viewpoint of inhibiting aggregation of the toner particles and reducing viscosity of the liquid developer, and from the viewpoint of improving pulverizability of the toner particles during the wet-milling, thereby obtaining a liquid developer having a small particle size.

A mass ratio of the basic dispersant to the polyester A, i.e. basic dispersant/polyester A, is preferably 0.01 or more, more preferably 0.02 or more, and even more preferably 0.03 or more, from the viewpoint of improving dispersion stability of the toner particles, thereby improving storage stability. In addition, the mass ratio is preferably 0.30 or less, more preferably 0.25 or less, and even more preferably 0.15 or less, from the viewpoint of reducing free dispersant, thereby improving electrophoretic property of the toner particles, and from the viewpoint of improving developability and fusing ability of the liquid developer.

[Insulating Liquid]

The viscosity of the insulating liquid at 25° C. is preferably 1.0 mPa·s or more, more preferably 1.2 mPa·s or more, and even more preferably 1.3 mPa·s or more, from the viewpoint of improving dispersion stability of the toner particles in a liquid developer, thereby improving storage stability, and from the viewpoint of improving pulverizability of the toner particles during wet-milling, thereby obtaining a liquid developer having a small particle size. In addition, the viscosity is preferably 30 mPa·s or less, more preferably 10 mPa·s or less, even more preferably 5 mPa·s or less, and even more preferably 3 mPa·s or less, from the viewpoint of improving electrophoretic property of the toner particles in the liquid developer, from the viewpoint of improving fusing ability of the liquid developer, and from the viewpoint of improving pulverizability of the toner particles during wet-milling, thereby obtaining a liquid developer having a small particle size. When two or more kinds of insulating liquids are used in combination, the viscosity of the combined insulating liquid mixture may be within the range defined above. Here, the viscosity of the insulating liquid at 25° C. is measured in accordance with a method described in Examples set forth below.

The insulating liquid means a liquid through which electricity is less like to flow, and in the present invention, a liquid having a dielectric constant of 3.5 or less and a volume resistivity of $10^7$ Ωcm or more is preferred.

Specific examples of the insulating liquid include, for example, aliphatic hydrocarbons, alicyclic hydrocarbons, aromatic hydrocarbons, halogenated hydrocarbons, polysiloxanes, vegetable oils, and the like. Especially, the aliphatic hydrocarbons such as liquid paraffin, isoparaffin and olefin having 12 or more and 18 or less carbon atoms are preferred, from the viewpoint of odor, harmlessness, and costs. Commercially available products of the aliphatic hydrocarbons include Isopar G, Isopar H, Isopar L, Isopar K, Isopar M, hereinabove manufactured by Exxon Mobile Corporation; ShellSol 71, ShellSol TM, manufactured by Shell Chemicals Japan Ltd; IP Solvent 1620, IP Solvent 2028, IP Solvent 2835, hereinabove manufactured by Idemitsu Kosan Co., Ltd.; MORESCO WHITE P-55, MORESCO WHITE P-70, MORESCO WHITE P-100, MORESCO WHITE P-150, MORESCO WHITE P-260, hereinabove manufactured by MORESCO Corporation; Cosmo White P-60, Cosmo White P-70, hereinabove manufactured by COSMO OIL LUBRICANTS, CO., LTD.; Lytol manufactured by Sonneborn; Isosol 400 manufactured by JX Nippon Oil & Energy Corporation, LINEALENE 14, LINEALENE 16, LINEALENE 18, LINEALENE 124, LINEALENE 148, LINEALENE 168, hereinabove manufactured by Idemitsu Kosan Co., Ltd.; and the like. Among them, one of them or two or more in combination can be used. Among them, an olefin having 12 or more and 18 or less carbon atoms is preferred, and an olefin having 12 or more and 16 or less carbon atoms is more preferred, from the viewpoint of improving electrophoretic property of the toner particles in the liquid developer, from the viewpoint of improving dispersion stability of the toner particles in the liquid developer, thereby improving storage stability, from the viewpoint of improving fusing ability of the liquid developer, and from the viewpoint of improving pulverizability of the toner particles during wet-milling, thereby obtaining a liquid developer having a small particle size. In addition, among the olefins, α-olefin is preferred, from the viewpoint of improving dispersion stability of the toner particles in the liquid developer, thereby improving storage stability, from the viewpoint of improving fusing ability of the liquid developer, and from the viewpoint of availability.

In a case where an olefin having 12 or more and 18 or less carbon atoms is contained in the insulating liquid, the content of the olefin is preferably 10% by mass or more, more preferably 20% by mass or more, even more preferably 40% by mass or more, even more preferably 60% by mass or more, even more preferably 80% by mass or more, even more preferably 90% by mass or more, even more preferably substantially 100% by mass, and even more preferably 100% by mass, of the insulating liquid, from the viewpoint of improving fusing ability of the liquid developer, and from the viewpoint of improving dispersion stability of the toner particles in the liquid developer, thereby improving storage stability.

As a method for mixing toner particles, an insulating liquid, and a basic dispersant, a method including stirring the components with an agitation mixer is preferred.

The agitation mixer is, but not particularly limited to, preferably high-speed agitation mixers, from the viewpoint of improving productivity and storage stability of the dispersion of toner particles. Specific examples are preferably DESPA manufactured by ASADA IRON WORKS CO., LTD.; T.K. HOMOGENIZING MIXER, T.K. HOMOGENIZING DISPER, T.K. ROBOMIX, hereinabove manufactured by PRIMIX Corporation; CLEARMIX manufactured by M Technique Co., Ltd; KADY Mill manufactured by KADY international, and the like.

The toner particles are previously dispersed by mixing toner particles, an insulating liquid, and a basic dispersant with a high-speed agitation mixer, whereby a dispersion of toner particles can be obtained, which in turn improves productivity of a liquid developer obtained in the subsequent wet-milling.

The solid content concentration of the dispersion of toner particles is preferably 20% by mass or more, more preferably 30% by mass or more, and even more preferably 33% by mass or more, from the viewpoint of improving the optical density of the liquid developer. In addition, the solid content concentration is preferably 50% by mass or less, more preferably 45% by mass or less, and even more preferably 40% by mass or less, from the viewpoint of improving electrophoretic property of the toner particles in the liquid developer, and from the viewpoint of improving dispersion stability of the toner particles in the liquid developer, thereby improving storage stability. Here, the solid content concentration of the dispersion of toner particles is measured in accordance with a method described in Examples set forth below.

[Wet-Milling]

The wet-milling is a method of subjecting toner particles dispersed in an insulating liquid to a mechanical milling treatment in a state of being dispersed in an insulating liquid.

As the apparatus used in the wet-milling, for example, generally used agitation mixers such as anchor blades can be used. The agitation mixers include high-speed agitation mixers such as DESPA manufactured by ASADA IRON WORKS CO., LTD., and T.K. HOMOGENIZING MIXER manufactured by PRIMIX Corporation; pulverizers and kneaders, such as roller mills, beads mill, kneaders, and extruders; and the like. These apparatuses can be used in a combination of plural mixers.

Among them, the beads mill is preferably used, from the viewpoint of making particle sizes of the toner particles in a liquid developer smaller, from the viewpoint of improving dispersion stability of the toner particles in a liquid developer, thereby improving storage stability, and from the viewpoint of reducing viscosity of the dispersion of toner particles.

By controlling particle sizes and filling ratios of media used, peripheral speed of rotors, residence time, and the like in the beads mill, toner particles having a desired particle size and a particle size distribution can be obtained.

The solid content concentration of the liquid developer is preferably 10% by mass or more, more preferably 15% by mass or more, and even more preferably 20% by mass or more, from the viewpoint of improving the optical density of the liquid developer. In addition, the solid content concentration is preferably 50% by mass or less, more preferably 45% by mass or less, and even more preferably 40% by mass or less, from the viewpoint of improving electrophoretic property of the toner particles in the liquid developer, and from the viewpoint of improving dispersion stability of the toner particles in a liquid developer, thereby improving storage stability. Here, the solid content concentration of the liquid developer is measured in accordance with a method described in Examples set forth below. After the preparation of the dispersion of toner particles, the solid content concentration of the dispersion of toner particles would be a solid content concentration of the liquid developer unless the dispersion is subjected to such a procedure as dilution or concentration.

The volume-median particle size $D_{50}$ of the toner particles in a liquid developer is preferably 5 μm or less, more preferably 3 μm or less, and even more preferably 2.5 Lm or less, from the viewpoint of making particle sizes of the toner particles in a liquid developer smaller, thereby improving image quality of the liquid developer. In addition, the volume-median particle size is preferably 0.5 μm or more, more preferably 1.0 μm or more, and even more preferably 1.5 μm or more, from the viewpoint of reducing viscosity of a liquid developer. Here, the volume-median particle size $D_{50}$ of the toner particles in a liquid developer is measured in accordance with a method described in Examples set forth below.

The viscosity of the liquid developer at 25° C. is preferably 50 mPa·s or less, more preferably 40 mPa·s or less, even more preferably 35 mPa·s or less, even more preferably 30 mPa·s or less, and even more preferably 28 mPa·s or less, from the viewpoint of improving electrophoretic property of the toner particles in the liquid developer. In addition, the viscosity is preferably 5 mPa·s or more, more preferably 10 mPa·s or more, even more preferably 13 mPa·s or more, and even more preferably 16 mPa·s or more, from the viewpoint of improving dispersion stability of the toner particles in a liquid developer, thereby improving storage stability. Here, the viscosity of a liquid developer is measured in accordance with a method described in Examples set forth below.

With regard to the embodiments described above, the present invention further discloses the following liquid developer.

<1> A liquid developer containing toner particles containing a resin and a basic dispersant in an insulating liquid, wherein the resin contains a polyester A having a furan ring.

<2> The liquid developer according to the above <1>, wherein the content of the polyester A is preferably 50% by mass or more, more preferably 80% by mass or more, even more preferably 90% by mass or more, even more preferably 95% by mass or more, even more preferably substantially 100% by mass, and even more preferably 100% by mass, of the resin, in other words, the polyester A alone is even more preferably used as a resin.

<3> The liquid developer according to any one of the above <1> or <2>, wherein the polyester A is a polyester obtained by polycondensing a carboxylic acid component and an alcohol component, using as raw material monomers at least a carboxylic acid component containing a carboxylic acid compound having a furan ring and/or an alcohol component containing an alcohol having a furan ring.

<4> The liquid developer according to the above <3>, wherein the carboxylic acid compound having a furan ring is preferably at least one member selected from the group containing the furan dicarboxylic acid compounds, the furan carboxylic acid compounds and the hydroxyfuran carboxylic acid compounds, more preferably the furan dicarboxylic acid compounds, and even more preferably 2,5-furan dicarboxylic acid.

<5> The liquid developer according to the above <3> or <4>, wherein a total amount of the carboxylic acid compound having a furan ring and the alcohol having a furan ring is preferably 10% by mol or more, more preferably 20% by mol or more, and even more preferably 30% by mol or more, and preferably 100% by mol or less, more preferably 80% by mol or less, even more preferably 60% by mol or less, and even more preferably 50% by mol or less, of a total amount of the carboxylic acid component and the alcohol component of the polyester A.

<6> The liquid developer according to any one of the above <3> to <5>, wherein the content of the carboxylic acid compound having a furan ring is preferably 20% by mol or more, more preferably 40% by mol or more, even more preferably 60% by mol or more, even more preferably 80% by mol or more, even more preferably 90% by mol or more, even more preferably substantially 100% by mol, and even more preferably 100% by mol, of the carboxylic acid component of the polyester A.

<7> The liquid developer according to any one of the above <4> to <6>, wherein the content of the furan dicarboxylic acid compound is preferably 20% by mol or more, more preferably 40% by mol or more, even more preferably 50% by mol or more, even more preferably 60% by mol or more, even more preferably 70% by mol or more, even more preferably 80% by mol or more, even more preferably 90% by mol or more, even more preferably substantially 100% by mol, and even more preferably 100% by mol, of the carboxylic acid component of the polyester A.

<8> The liquid developer according to any one of the above <3> to <7>, wherein the content of the alcohol having a furan ring is preferably 10% by mol or more, and more preferably 20% by mol or more, and preferably 100% by mol or less, more preferably 90% by mol or less, even more preferably 80% by mol or less, and even more preferably 60% by mol or less, of the alcohol component of the polyester A.

<9> The liquid developer according to any one of the above <3> to <8>, wherein the alcohol component contains an aliphatic diol.

<10> The liquid developer according to the above <9>, wherein the number of the carbon atoms of the aliphatic diol is preferably 2 or more, and more preferably 3 or more, and preferably 10 or less, more preferably 8 or less, and even more preferably 4 or less.

<11> The liquid developer according to the above <9> or <10>, wherein the aliphatic diol is preferably an aliphatic diol having a hydroxyl group bound to a secondary carbon atom, and preferably 1,2-propanediol.

<12> The liquid developer according to any one of the above <9> to <11>, wherein the content of the aliphatic diol is preferably 20% by mol or more, more preferably 50% by mol or more, even more preferably 70% by mol or more, even more preferably substantially 100% by mol, and even more preferably 100% by mol, of the alcohol component other than the alcohol having a furan ring.

<13> The liquid developer according to the above <11> or <12>, wherein the content of the aliphatic diol having a hydroxyl group bound to a secondary carbon atom is preferably 20% by mol or more, more preferably 50% by mol or more, even more preferably 70% by mol or more, even more preferably substantially 100% by mol, and even more preferably 100% by mol, of the alcohol component other than the alcohol having a furan ring.

<14> The liquid developer according to any one of the above <9> to <13>, wherein in a case where the alcohol component does not contain an alcohol having a furan ring, the content of the aliphatic diol is preferably 20% by mol or more, more preferably 50% by mol or more, even more preferably 70% by mol or more, even more preferably substantially 100% by mol, and even more preferably 100% by mol, of the alcohol component.

<15> The liquid developer according to any one of the above <11> to <14>, wherein in a case where the alcohol component does not contain an alcohol having a furan ring, the content of the aliphatic diol having a hydroxyl group bound to a secondary carbon atom is preferably 20% by mol or more, more preferably 50% by mol or more, even more preferably 70% by mol or more, even more preferably substantially 100% by mol, and even more preferably 100% by mol, of the alcohol component.

<16> The liquid developer according to any one of the above <3> to <15>, wherein the carboxylic acid component preferably contains terephthalic acid and/or fumaric acid, and more preferably contains terephthalic acid.

<17> The liquid developer according to any one of the above <1> to <16>, wherein the softening point of the polyester A is preferably 160° C. or lower, more preferably 120° C. or lower, even more preferably 110° C. or lower, and even more preferably 105° C. or lower, and preferably 70° C. or higher, more preferably 80° C. or higher, even more preferably 85° C. or higher, and even more preferably 88° C. or higher.

<18> The liquid developer according to any one of the above <1> to <17>, wherein the glass transition temperature of the polyester A is preferably 80° C. or lower, more preferably 65° C. or lower, and even more preferably 60° C. or lower, and preferably 40° C. or higher, more preferably 45° C. or higher, and even more preferably 50° C. or higher.

<19> The liquid developer according to any one of the above <I> to <18>, wherein the acid value of the polyester A is preferably 110 mgKOH/g or less, more preferably 70 mgKOH/g or less, even more preferably 50 mgKOH/g or less, and even more preferably 30 mgKOH/g or less, and preferably 3 mgKOH/g or more, more preferably 5 mgKOH/g or more, even more preferably 8 mgKOH/g or more, even more preferably 10 mgKOH/g or more, even more preferably 15 mgKOH/g or more, and even more preferably 20 mgKOH/g or more.

<20> The liquid developer according to any one of the above <1> to <19>, wherein the toner particles are obtained by a method including the step of melt-kneading toner raw materials, and thereafter pulverizing the melt-kneaded mixture.

<21> The liquid developer according to the above <20>, wherein the toner raw materials is preferably melt-kneaded with an open-roller type kneader.

<22> The liquid developer according to any one of the above <1> to <21>, obtained by a method including the step of dispersing the toner particles in an insulating liquid in the presence of a basic dispersant, and thereafter subjecting the toner particles to wet-milling.

<23> The liquid developer according to the above <22>, wherein beads mill is preferably used in the wet-milling.

<24> The liquid developer according to any one of the above <1> to <23>, wherein the basic dispersant is preferably one having a structure including a basic adsorbing group and a dispersing group in the same molecule, more preferably one having a structure including at least one member of basic adsorbing group selected from the group containing an amino group, an amide group and an imino group as a main chain, and a dispersing group having a hydrocarbon chain or a hydroxyhydrocarbon chain as a side chain, and even more preferably contains a condensate formed between a polyimnine and a carboxylic acid.

<25> The liquid developer according to the above <24>, wherein the polyimine used as a raw material for the condensate formed between a polyimine and a carboxylic acid is preferably a polyalkyleneimine, and more preferably polyethyleneimine.

<26> The liquid developer according to the above <24> or <25>, wherein the carboxylic acid used as a raw material for the condensate formed between a polyimine and a carboxylic acid is preferably a hydroxy aliphatic carboxylic acid having preferably 10 or more and 30 or less carbon atoms, more preferably 12 or more and 24 or less carbon atoms, and even more preferably 16 or more and 22 or less carbon atoms, and/or the condensates thereof, and more preferably 12-hydroxystearic acid and/or a condensate thereof.

<27> The liquid developer according to any one of the above <1> to <26>, wherein the amount of the basic dispersant is, as an effective content preferably 0.5 parts by mass or more, more preferably 1 part by mass or more, and even more preferably 2 parts by mass or more, and preferably 20 parts by mass or less, more preferably 15 parts by mass or less, even more preferably 10 parts by mass or less, and even more preferably 7 parts by mass or less, based on 100 parts by mass of the toner particles.

<28> The liquid developer according to any one of the above <24> to <27>, wherein the content of the condensate formed between a polyimine and a carboxylic acid in the basic dispersant is preferably 50% by mass or more, more preferably 70% by mass or more, even more preferably 90% by mass or more, even more preferably substantially 100% by mass, and even more preferably 100% by mass, of the effective content of the basic dispersant.

<29> The liquid developer according to any one of the above <1> to <28>, wherein the viscosity of the insulating liquid at 25° C. is preferably 1.0 mPa·s or more, more preferably 1.2 mPa·s or more, and even more preferably 1.3 mPa·s or more, and preferably 30 mPa·s or less, more preferably 10 mPa·s or less, even more preferably 5 mPa·s or less, and even more preferably 3 mPa·s or less.

<30> The liquid developer according to any one of the above <1> to <29>, wherein the insulating liquid is preferably an aliphatic hydrocarbon.

<31> The liquid developer according to the above <30>, wherein the aliphatic hydrocarbon is preferably an olefin having 12 or more and 18 or less carbon atoms, and more preferably an olefin having preferably 12 or more and 16 or less carbon atoms.

<32> The liquid developer according to the above <31>, wherein the olefin is preferably α-olefin.

<33> The liquid developer according to any one of the above <22> to <32>, wherein a solid content concentration of a dispersion of toner particles obtained by dispersing the toner particles in the insulating liquid in the presence of the basic dispersant is preferably 20% by mass or more, more preferably 30% by mass or more, and even more preferably 33% by mass or more, and preferably 50% by mass or less, more preferably 45% by mass or less, and even more preferably 40% by mass or less.

<34> The liquid developer according to any one of the above <1> to <33>, wherein a solid content concentration of the liquid developer is preferably 10% by mass or more, more preferably 15% by mass or more, and even more preferably 20% by mass or more, and preferably 50% by mass or less, more preferably 45% by mass or less, and even more preferably 40% by mass or less.

<35> The liquid developer according to any one of the above <1> to <34>, wherein the volume-median particle size $D_{50}$ of the toner particles in a liquid developer is preferably 5 μm or less, more preferably 3 μm or less, and even more preferably 2.5 μm or less, and preferably 0.5 μm or more, more preferably 1.0 μm or more, and even more preferably 1.5 μm or more.

<36> The liquid developer according to any one of the above <1> to <35>, wherein the viscosity of the liquid developer at 25° C. is preferably 50 mPa·s or less, more preferably 40 mPa·s or less, even more preferably 35 mPa·s or less, even more preferably 30 mPa·s or less, and even more preferably 28 mPa·s or less, and preferably 5 mPa·s or more, more preferably 10 mPa·s or more, even more preferably 13 mPa·s or more, and even more preferably 16 mPa·s or more.

<37> The liquid developer according to any one of the above <1> to <36>, wherein a mass ratio of the basic dispersant to the polyester A, i.e. basic dispersant/polyester A, is preferably 0.01 or more, more preferably 0.02 or more, and even more preferably 0.03 or more, and preferably 0.30 or less, more preferably 0.25 or less, and even more preferably 0.15 or less.

The physical properties of the resin and the like were measured in accordance with the following method.

[Softening Point of Resins]

The softening point refers to a temperature at which a half of the sample flows out, when plotting a downward movement of a plunger of a flow tester "CFT-500D" manufactured by Shimadzu Corporation, against temperature, in which a 1 g sample is extruded through a nozzle having a die pore size of 1 mm and a length of 1 mm with applying a load of 1.96 MPa thereto with the plunger, while heating the sample at a heating rate of 6° C./min.

[Glass Transition Temperature of Resin (Tg)]

Measurements are taken using a differential scanning calorimeter "DSC210," manufactured by Seiko Instruments Inc., by weighing out a 0.01 to 0.02 g sample in an aluminum pan, heating the sample to 200° C., and cooling the sample from that temperature to 0° C. at a cooling rate of 10° C./min. Next, the sample is heated at a heating rate of 10° C./min, and the endothermic peak is measured. A temperature of an intersection of the extension of the baseline of equal to or lower than the highest temperature of endothermic peak and the tangential line showing the maximum inclination between the kick-off of the peak and the top of the peak in the above measurement is defined as a glass transition temperature.

[Acid Value (AV) of Resin]

The acid value is determined by a method according to JIS K0070 except that only the determination solvent is changed from a mixed solvent of ethanol and ether as defined in JIS K0070 to a mixed solvent of acetone and toluene in a volume ratio of acetone:toluene=1:1.

[Volume-Median Particle Size $D_{50}$ of Toner Particles Before Mixing with Insulating Liquid]

Measuring Apparatus: Coulter Multisizer II, manufactured by Beckman Coulter, Inc.

Aperture Diameter: 100 μm

Analyzing Software: Coulter Multisizer AccuComp Ver. 1.19, manufactured by Beckman Coulter, Inc.

Electrolytic Solution: Isotone II, manufactured by Beckman Coulter, Inc.

Dispersion: "EMULGEN 109P," manufactured by KAO Corporation, polyoxyethylene lauryl ether, HLB: 13.6, is dissolved in the above electrolytic solution so as to have a concentration of 5% by mass.

Dispersion Conditions: Ten milligrams of a measurement sample is added to 5 ml of the above dispersion, and the mixture is dispersed for 1 minute with an ultrasonic disperser, and 25 ml of the above electrolytic solution is added to the dispersion, and further dispersed with an ultrasonic disperser for 1 minute, to prepare a sample dispersion.

Measurement Conditions: The above sample dispersion is added to 100 ml of the above electrolytic solution to adjust to a concentration at which particle sizes of 30,000 particles can be measured in 20 seconds, and thereafter the 30,000 particles are measured, and a volume-median particle size $D_{50}$ is obtained from the particle size distribution.

[Viscosity at 25° C. of Insulating Liquid and Liquid Developer]

A 6 mL glass sample vial "Vial with screw cap, No. 2," manufactured by Maruernu Corporation is charged with 4 to 5 mL of a measurement solution, and a viscosity at 25° C. is measured with a torsional oscillation type viscometer "VISCOMATE VM-10A-L," manufactured by SEKONIC CORPORATION.

[Solid Content Concentration in Dispersion of Toner Particles and in Liquid Developer]

Ten parts by mass of a sample is diluted with 90 parts by mass of hexane, and the dilution is rotated with a centrifuge instrument "H-201F," manufactured by KOKUSAN Co., Ltd. at a rotational speed of 25,000 r/min for 20 minutes. After allowing the mixture to stand, the supernatant is removed by decantation, the mixture is then diluted with 90 parts by mass of hexane, and the dilution is again centrifuged under the same conditions as above. The supernatant is removed by decantation, and the lower layer is then dried with a vacuum dryer at 0.5 kPa, 40° C. for 8 hours. The solid content concentration is calculated in accordance with to the following formula:

$$\text{Solid Content Concentration, \% by Mass} = \frac{\text{Mass of Residues After Drying}}{\text{Mass of Sample, Corresponding to 10 Parts by Mass Portion}} \times 100$$

[Volume-Median Particle Size $D_{50}$ of Toner Particles in Liquid Developer and Proportion of Particles Having Particle Sizes of 10 μm or More]

A volume-median particle size $D_{50}$ is determined with a laser diffraction/scattering particle size measurement instrument "Mastersizer 2000," manufactured by Malvern Instruments, Ltd., by charging a cell for measurement with Isopar G, manufactured by Exxon Mobile Corporation, isoparaffin, viscosity at 25° C. of 1 mPa·s, under conditions that a particle refractive index is 1.58, imaginary part being 0.1, and a dispersion medium refractive index of 1.42, at a concentration that give a scattering intensity of from 5 to 15%. In addition, the proportion of particles having a particle size of 10 Lm or more is calculated from the volume particle size distribution obtained.

Production Example 1 of Resins (Resins A to H)

A 5-L four-necked flask equipped with a thermometer, a stainless stirrer bar, a dehydration tube, and a nitrogen inlet tube was charged with raw material monomers, and an esterification catalyst, as listed in Table 1, and the contents were heated to 180° C. with a mantle heater, and thereafter the contents were heated to 210° C. over 10 hours. The contents were allowed to react at 210° C. until a reaction percentage reached 90%, the reaction mixture was further subjected to a reaction at 8.3 kPa until a softening point reached the temperature as listed in Table 1, to provide resins having physical properties as shown in Table 1. Here, the reaction percentage as used herein means a value calculated by: [amount of generated water in reaction (mol)/theoretical amount of generated water (mol)]×100.

Production Example 2 of Resin (Resin I)

A 5-L four-necked flask equipped with a thermometer, a stainless stirrer bar, a dehydration tube, and a nitrogen inlet tube was charged with raw material monomers, and an esterification catalyst, as listed in Table 1, and the contents were heated to 230° C. with a mantle heater. Thereafter, the contents were allowed to react at 230° C. until a reaction percentage reached 90%, and further subjected to a reaction at 8.3 kPa, and the reaction was terminated when a softening point reached 95° C., to provide Resin I having physical properties as shown in Table 1.

TABLE 1

| | | Resin A | Resin B | Resin C | Resin D | Resin E | Resin F | Resin G | Resin H | Resin I |
|---|---|---|---|---|---|---|---|---|---|---|
| Raw Material Monomers | 1,2-Propanediol | 1,893 g (100) | 1,886 g (100) | 1,871 g (100) | 1,857 g (100) | 1,820 g (100) | 1,893 g (100) | 1,893 g (100) | 1,820 g (100) | — |
| | BPA-PO[1)] | — | — | — | — | — | — | — | — | 3,685 g (100) |
| | Terephthalic Acid | — | 329 g (8) | 980 g (24) | 1,620 g (40) | 3180 g (80) | — | — | 3,180 g (80) | — |
| | 2,5-Furan Dicarboxylic Acid | 3,107 g (80) | 2,785 g (72) | 2,149 g (56) | 1,523 g (40) | — | 3,107 g (80) | 3,107 g (80) | — | 1,315 g (80) |
| Esterification Catalyst | Dibutyltin Oxide | 25 g | 25 g | 25 g | 25 g | 25 g | 25 g | 25 g | 25 g | 25 g |
| Physical Properties of Resins | Softening Point, ° C. | 94 | 94 | 95 | 95 | 96 | 88 | 102 | 86 | 95 |
| | Glass Transition Temperature, ° C. | 53 | 53 | 53 | 53 | 53 | 48 | 60 | 47 | 53 |
| | Acid Value, mgKOH/g | 26 | 24 | 21 | 17 | 8 | 33 | 15 | 10 | 24 |

Note)
Numerical values inside the parentheses express molar ratios when the total number of moles of the alcohol component is 100.
[1)]BPA-PO: Polyoxypropylene(2.2)-2,2-bis(4-hydroxyphenyl)propane The insulating liquids used in Examples and Comparative Examples are shown in Table 2.

[Table 2]

TABLE 2

| | Viscosity at 25° C., mPa · s | Chemical Name | Manufacturer and Trade Name |
|---|---|---|---|
| Liquid a | 2 | C14 α-Olefin (1-Tetradecene) | Idemitsu Kosan Co., Ltd., LINEALENE 14 |
| Liquid b | 2 | Liquid Paraffin | Idemitsu Kosan Co., Ltd., IP Solvent 2028 |

EXAMPLES 1 TO 8 AND COMPARATIVE EXAMPLES 1 AND 2

A resin as listed in Table 3 in an amount of 85 parts by mass and 15 parts by mass of a pigment "ECB-301," manufactured by DAINICHISEIKA COLOR & CHEMICALS MFG. CO., LTD., Phthalocyanine Blue, P.B. 15:3, were previously mixed with a 20-L Henschel mixer while stirring for 3 minutes at a rotational speed of 1,500 r/min (a peripheral speed of 21.6 m/sec), and the mixture was then melt-kneaded under the conditions set forth below.

[Melt-Kneading Conditions]

A continuous twin open-roller type kneader "Kneadex," manufactured by NIPPON COKE & ENGINEERING CO., LTD., outer diameter of roller: 14 cm, effective length of roller: 55 cm, was used. The operating conditions of the continuous twin open-roller type kneader are a rotational speed of a high-rotation roller (front roller) of 75 r/min (a peripheral speed of 32.4 n/min), a rotational speed of a low-rotation roller (back roller) of 35 r/min (a peripheral speed of 15.0 m/min), and a gap between the rollers at an end of the raw material supplying side of 0.1 mm. The temperatures of the heating medium and the cooling medium inside the rollers are as follows. The high-rotation roller had a temperature at the raw material supplying side of 90° C., and a temperature at the kneaded mixture discharging side of 85° C., and the low-rotation roller had a temperature at the raw material supplying side of 35° C., and a temperature at the kneaded mixture discharging side of 35° C. In addition, the feeding rate of the raw material mixture to the above kneader was 10 kg/h, and the average residence time in the above kneader was about 3 minutes.

The kneaded mixture obtained above was cooled with a cooling roller, and the cooled product was roughly pulverized to a size of 1 mm or so with a hammer-mill, and then finely pulverized and classified with an air jet type jet mill "IDS," manufactured by Nippon Pneumatic Mfg. Co., Ltd., to provide toner particles having a volume-median particle size $D_{50}$ of 10 μm.

A 1-L polyethylene vessel was charged with 35 parts by mass of toner particles obtained, 60.625 parts by mass of an insulating liquid as listed in Table 3, and 4.375 parts by mass of a basic dispersant "SOLSPARSE 13940," manufactured by The Lubrizol Corporation, a condensate formed between a polyimine and a carboxylic acid, effective content: 40%, and the contents were stirred with "T.K. ROBOMIX," manufactured by PRIMIX Corporation, under ice-cooling at a rotational speed of 7,000 r/min for 30 minutes, to provide a dispersion of toner particles having a solid content concentration of 37% by mass.

Next, the dispersion of toner particles obtained was subjected to wet-milling with 6 vessels-type sand mill "TSG-6," manufactured by AIMEX CO., LTD., at a rotational speed of 1,300 r/min (a peripheral speed of 4.8 m/sec) using zirconia beads having a diameter of 0.8 mm at a volume filling ratio of 60% by volume until a volume-median particle size $D_{50}$ as listed in Table 3 was obtained. The beads were filtered off, to provide each of liquid developers having a solid content concentration of 37% by mass, the liquid developer having physical properties as shown in Table 3.

COMPARATIVE EXAMPLE 3

The same procedures were carried out as in Example 1 except that 4.375 parts by mass of the basic dispersant "SOLSPARSE 13940," manufactured by The Lubrizol Corporation, a condensate formed between a polyimine and a carboxylic acid, effective content: 40%, was changed to 1.75 parts by mass of an acidic dispersant "SOLSPARSE 21000," manufactured by The Lubrizol Corporation, a polycarboxylic acid-based compound, effective content: 100%, and that the amount of the insulating liquid was changed from 60.625 parts by mass to 63.25 parts by mass. However, the toner particles could not be dispersed because of an increase in the viscosity upon wet-milling, and whereby a liquid developer could not be obtained.

TABLE 3

| | Resin | FDCA, % by mol[1)] | Tg of Resin, ° C. | AV of Resin, mgKOH/g | Dispersant | Insulating Liquid | Viscosity of Liquid Developer, mPa · s | $D_{50}$ of Toner Particles in Liquid Developer, μm |
|---|---|---|---|---|---|---|---|---|
| Ex. 1 | Resin A | 100 | 53 | 26 | S-13940 | Liquid a | 21 | 2.0 |
| Ex. 2 | Resin B | 90 | 53 | 24 | S-13940 | Liquid a | 22 | 2.0 |
| Ex. 3 | Resin C | 70 | 53 | 21 | S-13940 | Liquid a | 22 | 2.1 |
| Ex. 4 | Resin D | 50 | 53 | 17 | S-13940 | Liquid a | 21 | 2.1 |
| Ex. 5 | Resin F | 100 | 48 | 33 | S-13940 | Liquid a | 21 | 2.0 |
| Ex. 6 | Resin G | 100 | 60 | 15 | S-13940 | Liquid a | 23 | 2.2 |
| Ex. 7 | Resin I | 100 | 53 | 24 | S-13940 | Liquid a | 23 | 2.2 |
| Ex. 8 | Resin A | 100 | 53 | 26 | S-13940 | Liquid b | 25 | 2.2 |
| Comp. Ex. 1 | Resin E | 0 | 53 | 8 | S-13940 | Liquid a | 22 | 2.1 |
| Comp. Ex. 2 | Resin H | 0 | 47 | 10 | S-13940 | Liquid a | 23 | 2.1 |
| Comp. Ex. 3 | Resin A | 100 | 53 | 26 | S-21000 | Liquid a | could not be dispersed | |

[1)]FDCA: 2,5-furan dicarboxylic acid (carboxylic acid compound), content in the carboxylic acid component

TEST EXAMPLE 1

Storage Stability

A 20-mL glass sample vial "Vial with screw cap, No. 5," manufactured by Maruemu Corporation, was charged with 10 g of a liquid developer, and stored in a thermostat kept at 40° C. for 24 hours. In accordance with the measurement method of the volume-median particle size of the toner, the volume particle size distributions of the toners before and after storage were measured, and the proportion of particles having particle size of 10 μm or more (volume %) was then calculated, to evaluate the storage stability from the values of the differences before and after storage. The results are shown in Table 4. It is shown that the more the number approximates 0, the more preferable the dispersion stability of the toner particles and the more excellent the storage stability.

TEST EXAMPLE 2

Electrophoretic Property

Teflon (registered trademark) vessel having an external dimension of W 6.3 cm×D 4 cm×H 6.3 cm, and internal dimension of W 5 cm×D 1.1 cm×H 5 cm was inserted with two sheets of electrodes of which the weight was previously measured, made of stainless steel, having a dimension of W 4 cm×D 0.5 cm×H 5 cm (distance between electrodes: 0.1 cm). One gram of the liquid developer was diluted with 7.75 g of an insulating liquid to prepare a sample solution, 3 g of this sample solution was placed between two sheets of electrodes, and both the electrodes were applied with direct voltage of ±300 V for 90 seconds using a DC power supply "TMK1.5-50," manufactured by Takasago Ltd. The both electrodes were pulled out, the electrodes were dried in a vacuum drier at 0.5 kPa, 100° C. for 1 hour, and the mass of each of electrodes after drying was measured. A value of (mass of electrodes after drying)−(mass of electrodes before applying voltage) was obtained for each of a cathode and an anode, and the value was defined as the mass of toner deposited to each of electrodes. The results are shown in Table 4. It is shown that the larger the mass of the toner particles on anode and the smaller the mass of the toner particles on cathode, the more excellent the positive chargeability.

TEST EXAMPLE 3

Fusing Ability

A liquid developer was dropped on "POD Gloss Coated Paper," manufactured by Oji Paper Co., Ltd., and spread with a wire bar so as to prepare a thin film having a weight of 1.2 g/m$^2$ on a dry basis.

The prepared thin film was kept in a thermostat at 60° C. for 10 seconds, and thereafter fused at a printing speed of 140 mm/sec, with an external fuser taken out of the fusing apparatus of "OKI MICROLINE 3010," manufactured by Oki Data Corporation, the fusing roller of which was set at 140° C.

The resulting fused images were adhered to a mending tape "Scotch Mending Tape 810," manufactured by 3M, width of 18 mm, the tape was pressed with a roller so as to have a load of 500 g being applied thereto, and the tape was removed. The optical densities before and after tape removal was measured with a colorimeter "Spectroeye," manufactured by X-Rite. The image-printed portions were measured at 3 points each, and an average thereof was calculated as an optical density. A fusing ratio (%) was calculated from a value obtained by [optical density after removal]/[optical density before removal]×100, to evaluate fusing ability. The results are shown in Table 4. It is shown that the larger the numerical values, the more excellent the fusing ability.

[Table 4]

TABLE 4

| | Storage Stability | | | Electrophoretic Property | | Fusing Ability |
|---|---|---|---|---|---|---|
| | Before Storage X [1] | After Storage Y [2] | Y − X | Deposition Amount on Anode, g | Deposition Amount on Cathode, g | [Fusing Ratio, %] |
| Ex. 1 | 0 | 0 | 0 | 33 | 0 | 95 |
| Ex. 2 | 0 | 0 | 0 | 30 | 0 | 93 |
| Ex. 3 | 0 | 0 | 0 | 28 | 0 | 88 |
| Ex. 4 | 0 | 0 | 0 | 22 | 0 | 85 |
| Ex. 5 | 0 | 2 | 2 | 28 | 0 | 96 |
| Ex. 6 | 0 | 0 | 0 | 30 | 0 | 86 |
| Ex. 7 | 0 | 0 | 0 | 26 | 0 | 85 |
| Ex. 8 | 0 | 0 | 0 | 32 | 0 | 92 |
| Comp. Ex. 1 | 0 | 5 | 5 | 2 | 0 | 76 |
| Comp. Ex. 2 | 0 | 12 | 12 | 1 | 0 | 83 |
| Comp. Ex. 3 | could not be dispersed | | | | | |

[1] Proportion of particles having particle sizes of 10 μm or more in liquid developer before storage at 40° C. for 24 hours, % by volume
[2] Proportion of particles having particle sizes of 10 μm or more in liquid developer after storage at 40° C. for 24 hours, % by volume As clear from Table 4, it can be seen that the liquid developers of Examples 1 to 8 have excellent storage stability and electrophoretic property, and also have excellent fusing ability, as compared to those of Comparative Examples 1 to 3.

The liquid developer of the present invention is suitably used in development and the like of latent images formed in an electrophotographic method, an electrostatic recording method, an electrostatic printing method, or the like.

The invention claimed is:

1. A liquid developer, consisting essentially of:
toner particles comprising a resin and
a basic dispersant
in an insulating liquid,
wherein the resin comprises a polyester A having a furan ring, and
wherein the basic dispersant comprises a polycondensed product of a polyimine and a carboxylic acid.

2. The liquid developer according to claim 1, wherein the polyester A is a polyester obtained by polycondensing a carboxylic acid component and an alcohol component, and
wherein at least one of the carboxylic acid component and the alcohol component comprises a raw material monomer having a furan ring.

3. The liquid developer according to claim 2, wherein
the carboxylic acid component comprises a raw material monomer having a furan ring, and a total amount of the raw material monomer of the carboxylic acid component that has a furan ring is 10% by mol or more and 100% by mol or less of a total amount of the carboxylic acid component and the alcohol component;
the alcohol component comprises a raw material monomer having a furan ring, and a total amount of the raw material monomer of the alcohol component that has a furan ring is 10% by mol or more and 100% by mol or less of a total amount of the carboxylic acid component and the alcohol component; or
each of the carboxylic acid component and the alcohol component comprises a raw material monomer having a furan ring and a total amount of the raw material monomer that has a furan ring in each of the carboxylic acid component and the alcohol component is 10% by mol or more and 100% by mol or less of a total amount of the carboxylic acid component and the alcohol component.

4. The liquid developer according to claim 2, wherein the alcohol component comprises an aliphatic diol.

5. The liquid developer according to claim 4, wherein the aliphatic diol is an aliphatic diol having a hydroxyl group bound to a secondary carbon atom.

6. The liquid developer according to claim 2, wherein the carboxylic acid component comprises at least one of terephthalic acid and fumaric acid.

7. The liquid developer according to claim 2, wherein the carboxylic acid component comprises a carboxylic acid compound having a furan ring, and wherein the content of the carboxylic acid compound having a furan ring is 20% by mol or more and 100% by mol or less of the carboxylic acid component of the polyester A.

8. The liquid developer according to claim 1, wherein the content of polyester A having a furan ring is 50% by mass or more of the resin.

9. The liquid developer according to claim 1, wherein an amount of the basic dispersant is 0.5 parts by mass or more and 20 parts by mass or less, based on 100 parts by mass of the toner particles.

10. The liquid developer according to claim 1, wherein a mass ratio of the basic dispersant to the polyester A, basic dispersant/polyester A, is 0.01 or more and 0.30 or less.

11. The liquid developer according to claim 1, wherein a viscosity at 25° C. of the liquid developer is 5 mPa·s or more and 50 mPa·s or less.

12. The liquid developer according to claim 1, wherein the insulating liquid comprises an aliphatic hydrocarbon.

13. A liquid developer, comprising:

toner particles comprising a resin and a basic dispersant in an insulating liquid comprising an olefin having 12 or more and 18 or less carbon atoms, wherein the resin comprises a polyester A having a furan ring.

14. The liquid developer according to claim 1, wherein an acid value of the polyester A is 10 mgKOH/g or more and 50 mgKOH/g or less.

15. The liquid developer according to claim 1, wherein a volume-median particle size of the toner particles in a liquid developer is 0.5 μm or more and 5 μm or less.

16. The liquid developer of claim 1, wherein a content of the basic dispersant is from 0.5 to 20 parts by mass, with respect to 100 parts by mass of the toner particles, and wherein a solid content in the liquid developer is from 10% by mass to 50% by mass.

17. The liquid developer of claim 1, wherein the liquid developer is capable of storage at 40° C. for 24 hours while maintaining a content by volume of particles having a particle size of 10 μm or more in the toner particles of from 0% to 2%.

* * * * *